US005791619A

United States Patent [19]

Myers

[11] Patent Number: 5,791,619

[45] Date of Patent: Aug. 11, 1998

[54] ANTI-TORQUE REACTION ARM

[75] Inventor: Kenneth C. Myers, Fort Wayne, Ind.

[73] Assignee: phd, Inc., Fort Wayne, Ind.

[21] Appl. No.: 742,514

[22] Filed: Nov. 1, 1996

[51] Int. Cl.[6] ..... A47H 1/10

[52] U.S. Cl. ..... 248/317

[58] Field of Search ..... 248/317, 320, 248/321, 325, 327, 329, 330.1; 81/57.4

[56] References Cited

U.S. PATENT DOCUMENTS

| | | | |
|---|---|---|---|
| 1,102,947 | 7/1914 | Nissen . | |
| 1,895,037 | 1/1933 | Herndon . | |
| 2,740,508 | 4/1956 | Shaff . | |
| 2,777,346 | 1/1957 | Brame . | |
| 3,127,147 | 3/1964 | Spangenberg | 248/327 |
| 3,191,647 | 6/1965 | Monnin . | |
| 3,397,749 | 8/1968 | Haskins et al. | 248/325 X |
| 3,969,961 | 7/1976 | Amoroso | 81/52.4 R |
| 4,774,864 | 10/1988 | Dossier | 81/474 |
| 4,813,312 | 3/1989 | Wilhelm | 81/467 |
| 5,367,924 | 11/1994 | Henson et al. | 81/57.4 |
| 5,415,065 | 5/1995 | McMills | 81/467 |
| 5,580,021 | 12/1996 | Gillanders | 248/330.1 |

*Primary Examiner*—Ramon O. Ramirez
*Attorney, Agent, or Firm*—O'Malley and Firestone

[57] ABSTRACT

A tool suspension arm provides isolation to a user from torque produced by a hand tool while allowing substantial freedom in positioning the hand tool relative to a workpiece. The arm has a housing defining an axially extensive cavity open at one end. An axially extensive rod is received by the axially extensive cavity through the open end for longitudinal movement relative to the housing. The axially extensive rod is splined and is closed in the axially extensive cavity of the housing by a splined hub insert inserted over the axially extensive rod into the open end of the axially extensive cavity. Cooperation between the splined surfaces largely eliminates play between the rod and housing and rotationally locks rod and housing preventing reactive twisting movement of the tool in use.

16 Claims, 2 Drawing Sheets

ANTI-TORQUE REACTION ARM

BACKGROUND OF THE INVENTION

1. Field of the Invention

The present invention relates to an apparatus for supporting torque producing tools and more particularly a workstation support which isolates workers using torque producing tools from torque produced by a tool.

2. Description of the Problem

The workstation assembly of components is typically eased by providing suspended tools used in assembly work. For example, a powered screwdriver may be mounted on an arm which is, in turn, hung from an overhead bar or moving trolly. The arm will typically be jointed to allow positioning of the screwdriver adjacent to a workpiece and will include a spring mechanism for pulling the powered screwdriver up and away from the work area when the worker releases the tool. Air hoses or power cords may be present for attachment to provide power for the tools.

Powered screwdrivers generate reactive twisting motion and, if freely held, that motion is transmitted to the worker's arm. Workers doing assembly work are exposed repeatedly to such reactive twisting motion which in time can result in chronic ailments. The problem has been recognized and some companies have attempted to address it with torque control devices such as the "Tork Inhibitor" sold by Colonial Tool & Electronics of Caledonia, Ohio, which provides some of the flexibility provided by common tool suspension mechanisms.

Unfortunately, possibly due to cost considerations, most powered torque generating tools are suspended from simple extensible arms, typically constructed from a square cross section tube fitted into a second, larger square cross sectional tube. Such systems inherently allow for a certain amount of give between the tubes, stemming from a loose fit between the tubes and from contact between the tubes occurring along one edge of each of the adjacent interior and exterior surfaces of each tube. Because contact between adjacent surfaces occurs as a collision, the problem becomes worse with time as repeated applications of twisting to the system deform the facing surfaces of the extensible arms. As a result ever more twisting movement is absorbed in the wrist and arm of a worker using a tool suspended from such an arm over time.

SUMMARY OF THE INVENTION

It is one object of the invention to provide a tool suspension arm for use with torque generating hand tools.

It is another object of the invention to provide a tool suspension arm which isolates a user from torque generated by a hand tool mounted on the arm.

It is still another object of the invention to provide an extensible tool suspension arm which isolates a user from torque generated by a hand tool mounted on the arm at all permitted degrees of extension.

The invention provides a tool suspension arm having a housing defining an axially extensive cavity open at one end. An axially extensive rod is received by the axially extensive cavity through the open end for slidable axial movement relative to the housing. The axially extensive rod is splined and is closed in the axially extensive cavity of the housing by a splined hub insert inserted over the axially extensive rod into the open end of the axially extensive cavity. Contact between rod and housing occurs along the spline surfaces largely eliminating rotational play between the rod and housing and preventing reactive twisting movement. A bearing member attached to the end of the axially extensive rod inserted into the cavity conforms in shape to the interior shape of the cavity and helps keep alignment between the rod and the housing. A first universal joint member attached to the housing at an end opposite the end receiving the axially extensive rod provides for suspension of the tool suspension arm to a fixed support. A second universal joint attached to the axially extensive rod opposite the end of the rod received by the housing provides for attachment of a torque producing tool. A spring biased retraction mechanism is attached between the housing and the rod to bias the rod toward a retracted position.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
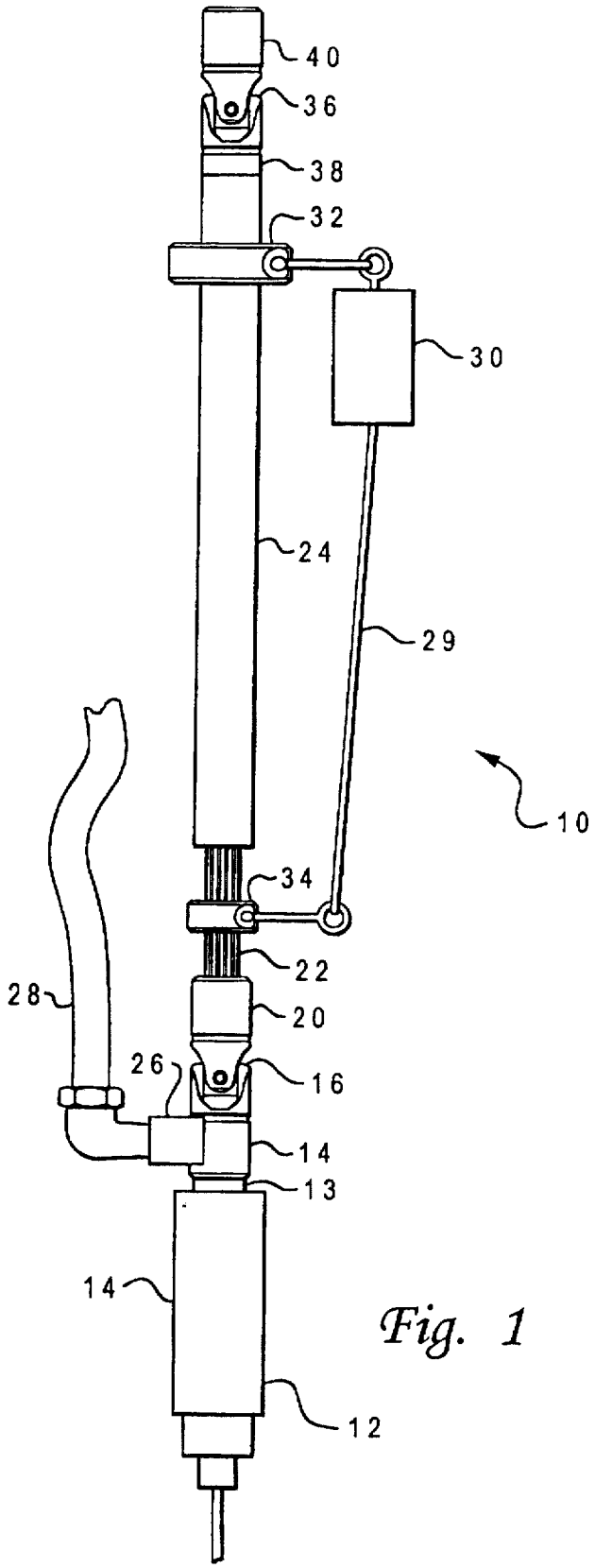
FIG. 1 is a side view of a anti-torque tool suspension arm in accordance with the invention.

Referring now to the drawings, wherein equal numerals refer to like objects between the FIGS., and more particularly to FIG. 1, an anti-torque suspension arm 10 in accordance with the invention is shown. Anti-torque suspension arm 10 provides a workstation support for a torque tool 12 which permits workers easy, nearly universal flexibility in positioning and orienting the torque tool with respect to a workpiece (not shown). To use torque tool 12 a worker typically grasps torque tool 12 around a major cylindrical surface 14 and then pulls the tool to and holds the tool in a particular position and orientation. Torque tool 12 is typically an air driven pneumatic tool such as a screwdriver which generates a twisting reaction when applied to drive a screw or tighten a nut on a workpiece. Torque tool 12 may be powered by other sources such as electric motors. Suspension arm 10 is extensible and includes upper and lower universal joints 36 and 16 accommodate positioning and orienting torque tool 12.

Torque tool 12 is joined to suspension arm 10 by insertion of an adaptor 13 extending from the tool into a socketed lower member 14 of a lower universal joint 16. An upper socketed member 20 of universal joint 16 is attached to a splined bar 22 which extends into an axially extensive housing 24. Socketed lower member 14 includes an externally accessible port 26 allowing connection to an air hose 28, which supplies air under pressure to drive torque tool 12. In the case of an electric tool, torque tool 12 is joined to lower universal joint 16 by a holding bracket (not shown). As is well understood by those skilled in the art, universal joint 16 is a coupling which can transmit rotary power at any selected nonzero angle. Here reactive twisting force generated by torque tool 12 is transmitted through lower universal joint 16 to splined shaft or bar 22 at any physically possible orientation of tool 12.

Suspension arm 10 provides automatic retraction of torque tool 12 upon release. A cable 29 dispensed from a spring loaded reel 30 attached to collar 32 and is connected to collar 34, which is mounted on splined bar 22. Collar 32 is in turn mounted on the exterior surface of housing 24. Spring loaded reel 30 biases splined bar 22 toward a retracted position. Alternative retraction mechanisms could be used, such a spring mounted inside housing 24, a vacuum retraction system or other mechanism.

An upper universal joint 36 is mounted by its lower member 38 into the top end of housing 24. An upper member 40 is socketed to allow connection of suspension arm 10 to the rigid frame of a workstation (not shown), a trolly (not shown), or some other external support. All that is required is that the external support resist rotation. Universal joint 36 transmits rotational force from housing 24 to the external frame.

While the preferred orientation of anti-torque suspension arm 10 is shown, those skilled in the art will now realize that the anti-torque suspension arm may be configured to allow attachment of torque tool 12 to upper universal joint 36 allowing the entire arm to mounted in the reverse orientation to that shown.

Figure 2:
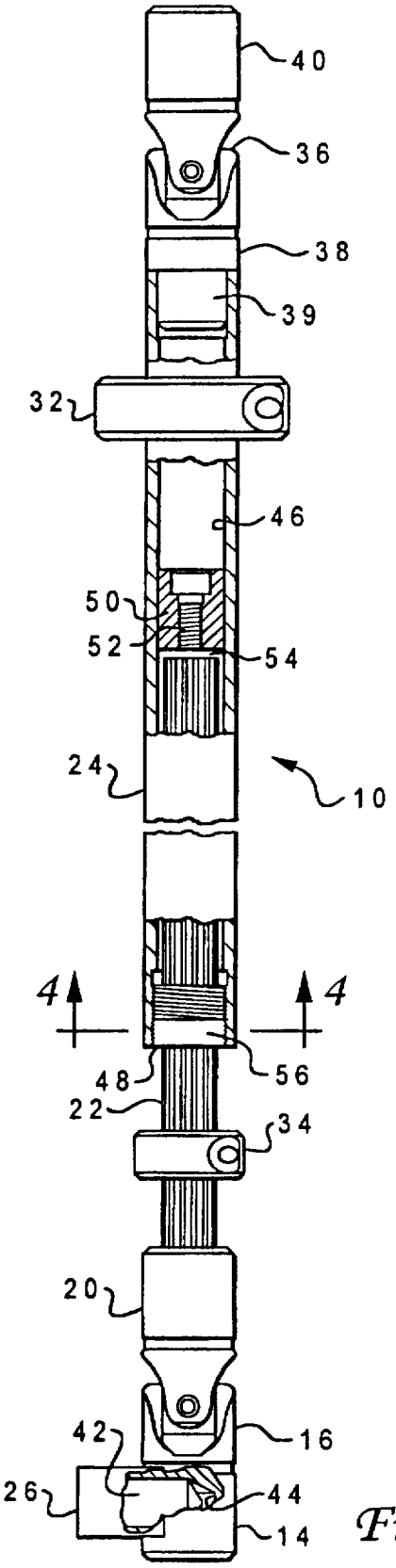
FIG. 2 is a partial cutaway, partial cross sectional side view of the anti-torque tool suspension arm.

FIG. 2 illustrates in partial cross section more detail of anti-torque suspension arm 10. Lower universal joint member 14 includes a air passage 42 from duct 26 through the member to a mounting port 44 allowing communication of pressurized air from an external source to a tool mounted on lower universal joint member 14.

Splined bar 22 is partially inserted into an open end 48 of an axially extensive cylindrically shaped cavity 46. A cylindrically shaped bearing 50 is mounted by an axially aligned screw 52 to the top of splined bar 22, spaced from the bar by a washer 54. Bearing 50 fits snugly against the interior surface of axially extensive cavity 46 and helps maintain the longitudinal axial alignment of splined bar 22 in cavity 46. This in turn helps prevent longitudinal binding of splined bar 22 in splined hub insert 56.

Full withdrawal of splined bar 22 from cavity 46 is prevented by a threaded splined hub insert 56 fitted around splined bar 22 and screwed into open end 48 of cavity 46. Bearing 50 and hub insert 56 provide two points of support along splined rod 22 preventing movement of the rod away from axial alignment with housing 24. Splined hub insert 56 and splined bar 22 are rotationally tightly locked. Twisting reaction produced by a torque tool 12 is braced against through lower universal joint 16, the cooperating splined bar 22 and splined hub insert 56, and upper universal joint 36, while maintaining freedom of movement, other than rotation, in positioning torque tool 12. A user of torque tool 12 perceives virtually no rotational reaction from torque tool 12 produced upon use of the tool.

Figure 3:
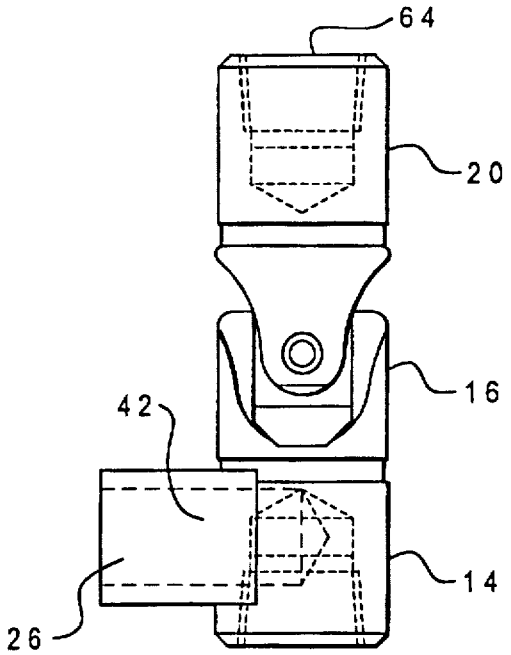
FIG. 3 is view of a universal joint member modified to support a air driven torque tool.

FIG. 3 illustrates lower universal joint 16. Conventional air driven torque tools 12 are designed to receive air through a plug adaptor such as adaptor 13. Lower universal joint 16 provides air through a duct 26 for connection to an air hose and through a right angled air passage 42 in lower member 14 into mounting port 44, which is shaped to receive adaptor 13. Upper member 20 has a socket 64 for receiving splined bar 22.

Figure 4:
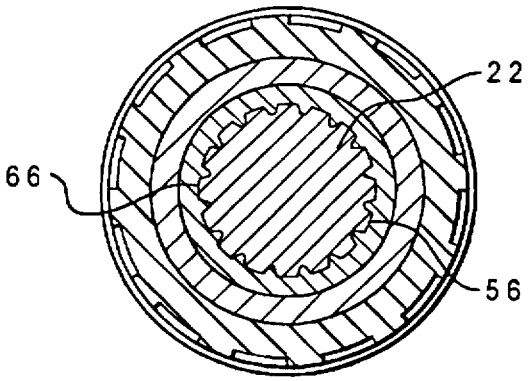
FIG. 4 is a cross sectional view taken along section line 4 in FIG. 2.

FIG. 4 illustrates a preferred spline arrangement 66 for anti-torque reaction arm, comprising a large plurality of interlocking splines and grooves on the exterior surface of splined bar 22 and the interior surface of splined hub insert 56. Splined hub insert 56 is inserted into housing 24. Other spline arrangements are possible, such as an arrangement of one or more keys and key ways. Splined hub insert 56 may provide an equal or greater number of slots for the splines or keys of splined bar 22. Also, the keyways may be in the bar or shaft and the cooperating keys may extend inwardly from the splined hub. In general, torque pressure between interlocking splines or keys and key ways should be applied substantially evenly and generally perpendicularly to the interfering surfaces of the splines or keys and key ways. In square or hexagonal cross section shafts and hubs of the prior art, pressure is applied toward an edge of each meeting face, an arrangement that over time contributes to deterioration of the parts and greater sloppiness in fit.

The invention provides a durable tool suspension arm for use with torque generating hand tools which protects its users from reactive torque produced by a hand tool mounted on the arm. Additionally, the invention provide an extensible tool suspension arm permits substantial freedom in positioning a hand tool.

While the invention is shown in only one of its forms, it is not thus limited but is susceptible to various changes and modifications without departing from the spirit and scope of the invention.

What is claimed is:

1. Apparatus comprising:

a housing defining an axially extensive cavity open at one end;

an axially extensive rod received by the axially extensive cavity through the open end for slidable axial movement relative to the housing;

a first universal joint attached to the housing at an end opposite the end receiving the axially extensive rod;

a second universal joint attached to the axially extensive rod opposite the end of the rod received by the housing;

an attachment port on one of the universal joints for supporting a torque tool;

an hub insert positioned in the axially extensive cavity at the open end defining an interior passage for the axially extensive rod; and at least first interfering surfaces on the hub insert and the axially extensive rod for rotationally locking the housing and the axially extensive rod.

2. Apparatus as set forth in claim 1, further comprising:

the axially extensive cavity having a surface; and a shaped bearing sized to snugly fit within the axially extensive cavity positioned on an inserted portion of the axially extensive rod.

3. Apparatus as set forth in claim 2, further comprising:

the hub insert obstructing withdrawal of the axially extensive rod by blocking the passage of the cylindrically shaped bearing.

4. Apparatus as set forth in claim 3, wherein the insert and the axially extensive rod have a like plurality of cooperating splines.

5. Apparatus as set forth in claim 3, further comprising:

the attachment port for the torque tool extends from the second universal joint and communicates with an externally accessible air duct.

6. Apparatus as set forth in claim 3, further comprising:

a retraction mechanism biasing the axially extensive shaft toward a retracted position within the housing.

7. Apparatus as set forth in claim 3, further comprising:

an attachment point on the first universal joint for hanging the apparatus from a support frame; and a second attachment point mounted on the axially extensive rod at a point external to the axially extensive cavity; and a retraction mechanism connected between the first and the second attachment points.

8. An anti-torque reaction arm comprising:

a first universal joint adapted at a first end for attachment to a fixed support;

a housing depending from a second end of the first universal joint defining a cylindrically shaped axially extensive cavity open at one end;

an axially extensive splined shaft received by the axially extensive cavity through the open end for slidable axial movement relative to the housing;

a bearing mounted on the inserted end of the axially extensive splined shaft shaped to fit snugly against the surface of the cylindrically shaped axially extensive cavity;

a hub splined insert positioned in the open end of the cylindrically shaped axially extensive cavity for supporting the axially extensive shaft and preventing withdrawal of the bearing from the axially shaped extensive cavity;

a second universal joint mounted to the uninserted end to the axially extensive splined shaft; and a tool connection point on the second universal joint.

9. An anti-torque reaction arm as set forth in claim 8, and further comprising:

a attachment point for an air hose in the second universal joint; and an air duct through a portion of the second universal joint communicating between the tool connection point and attachment point for the air hose.

10. An anti-torque reaction arm as set forth in claim 9, and further comprising:

a first collar fitted around an uninserted portion of the axially extensive splined shaft allowing attachment to a retraction mechanism for biasing the axially extensive splined shaft toward an unextended position.

11. A suspension arm comprising:

a first universal joint;

a receiving section having a closed end attached with respect to the first universal joint, an open end and defining an axially extensive cavity communicating with the open end;

an extensible bar having a first end disposed within the axially extensive cavity, a second end extending outwardly through the open end from the axially extensive cavity and at least a first spline extending longitudinally along the extensible bar;

a hub disposed in the open end around the extensible bar, the hub having at least a first spline cooperating with the at least first spline of the extensible bar for rotationally locking the extensible bar with the receiving section; and a second universal joint attached with respect to the second end of the extensible bar.

12. A tool suspension arm as described in claim 11, wherein the first universal joint has a mounting point for attachment of the tool suspension arm to an external support and further wherein the second universal joint has a mounting point for attachment of a torque generating tool.

13. A tool suspension arm as described in claim 12, further comprising:

an interior surface to the receiving section defining a portion of the axially extensive cavity; and a bearing attached to the first end of the extensible bar, the bearing having a surface shaped to slide snugly along the interior surface.

14. A tool suspension arm as described in claim 13, wherein the interior surface is a longitudinally extended, cylindrical interior surface and the bearing circumferentially conforms thereto.

15. A tool suspension arm as described in claim 14, further comprising:

a retraction mechanism biasing the extensible bar toward a retracted position in the receiving section.

16. A tool suspension arm as described in claim 15, further comprising:

a first attachment point mounted relative to the extensible bar;

a second attachment point mounted relative to the receiving section; and the retraction mechanism including a spring biased mechanism connected between the first and second attachment points.

* * * * *